United States Patent [19]

Stone, Jr.

[11] 4,361,257

[45] Nov. 30, 1982

[54] APPARATUS FOR REDUCING OXIDATION OF COFFEE

[75] Inventor: Wayne B. Stone, Jr., Bethesda, Md.

[73] Assignee: Wood Manufacturing Co., Inc., Flippin, Ark.

[21] Appl. No.: 219,461

[22] Filed: Dec. 23, 1980

[51] Int. Cl.[3] ..... A47G 19/14

[52] U.S. Cl. ..... 222/464; 99/275; 222/465

[58] Field of Search ..... 222/211, 464, 213, 570, 222/166, 386.5, 131, 130, 152, 478, 465; 99/318, 319, 320

[56] References Cited

U.S. PATENT DOCUMENTS 642,960 2/1900 Clibborn ..... 222/386.5

3,184,110 11/1962 Gombar et al. ..... 222/567

FOREIGN PATENT DOCUMENTS 35071 10/1905 Switzerland ..... 222/464

*Primary Examiner*—Stanley H. Tollberg

*Attorney, Agent, or Firm*—Beveridge, DeGrandi & Kline

[57] ABSTRACT

A top assembly which includes an elongate pour spout and movable follower element is interfitted with the open top of a coffee receptacle whereby coffee may be dispensed through the pour spout while maintaining the main body of coffee isolated from atmosphere.

6 Claims, 9 Drawing Figures

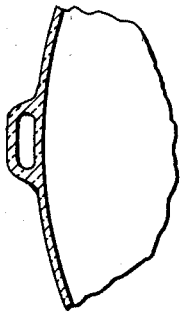
FIG. 9
FIG 8
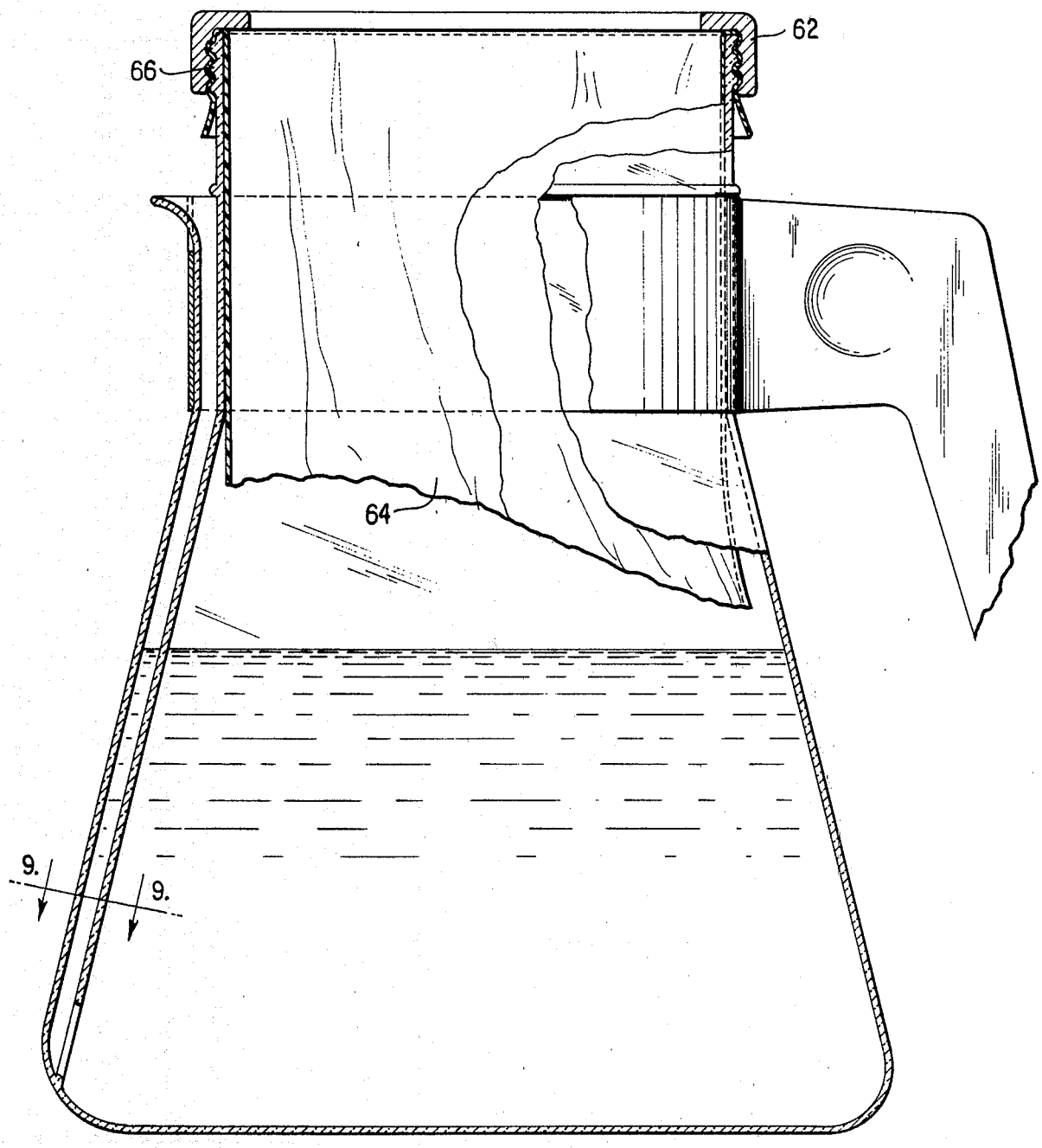

APPARATUS FOR REDUCING OXIDATION OF COFFEE

BACKGROUND OF THE INVENTION

The concept of extending the "pot life" of coffee, i.e. that time period during which it retains the flavor and aroma of freshly brewed coffee, by substantially eliminating its exposure to atmosphere while yet retaining the ability to pour coffee in conventional fashion was introduced by applicant's prior U.S. Pat. No. 3,974,758, the disclosure of which is hereby incorporated by reference. In a pour type coffee receptacle, the concept involves sealing the main body of contained coffee with respect to atmosphere. The top of the receptacle is sealed by a movable follower, such as a bellows or bag, and that coffee contained within the lower end of a small pour spout opening into the coffee receptacle adjacent the bottom thereof serves as a liquid seal between atmosphere and the main body of the receptacle contained coffee.

The result is that the only oxidation that can occur takes place at the upper coffee level in the pour spout. By keeping the cross section of the pour spout sufficiently small, that quantity of coffee that is oxidized and subsequently finds its way through the liquid seal to the main reservoir of contained coffee is negligible over the first 4-8 hours depending upon the cross section of the pour spout.

Stated differently, the patented concept involves pouring coffee from the bottom of the pot while keeping the top of the pot sealed with a movable follower maintaining atmospheric pressure on the coffee so that it can be poured without creating a vacuum lock.

Previously, the pour spout for "pouring from the bottom" of the pot has been formed externally of the pot as illustrated in U.S. Pat. No. 3,974,758. This, of course, requires special tooling since conventional coffee pots are not made with small cross section pour spouts opening into the lower portion of the pot.

The purpose of the present invention is to adapt the patented concept for use with conventionally manufactured coffee receptacles and, more particularly, those conventional glass coffee receptacles used with automatic, flow-through coffee makers.

SUMMARY OF THE INVENTION

The open, upper end of a conventional coffee receptacle is fitted with a sealing top assembly which includes a flexible follower and an elongate pour spout extending from the upper surface of the top to the lower end of the receptacle. The top assembly is adapted for sealing engagement with the top of the receptacle and the follower is sealed with respect to the top assembly. The top assembly is vented internally of the follower whereby the interior of the follower is exposed to atmospheric pressure while the interior of the receptacle is sealed with respect to atmosphere by the flexible follower. Thus when the receptacle is filled with coffee and the top assembly interfitted therewith, the only surface area exposure of the coffee to atmosphere is at the upper coffee level in the pour spout since the upper surface of the reservoir of coffee in the receptacle is sealed with respect to atmosphere by the follower.

As coffee is dispensed by pouring in conventional fashion from the pour spout, the follower expands to preclude the establishment of a vacuum lock.

The top assembly may be interfitted with the open receptacle top in any desired manner such as by a friction-fitted O-ring engagement or screw threaded engagement so long as the purpose of the invention is met; e.g. to pour from the bottom of the receptacle through the sealed top thereof via an internally contained pour spout.

DESCRIPTION OF THE DRAWINGS

FIG. 8 is a sectional view with parts broken away and parts in section showing the receptacle of FIG. 7 assembled with a top and bag type follower; and FIG. 9 is a sectional view taken along lines 9—9 of FIG. 8.

DESCRIPTION OF THE PREFERRED EMBODIMENTS

Figure 7:
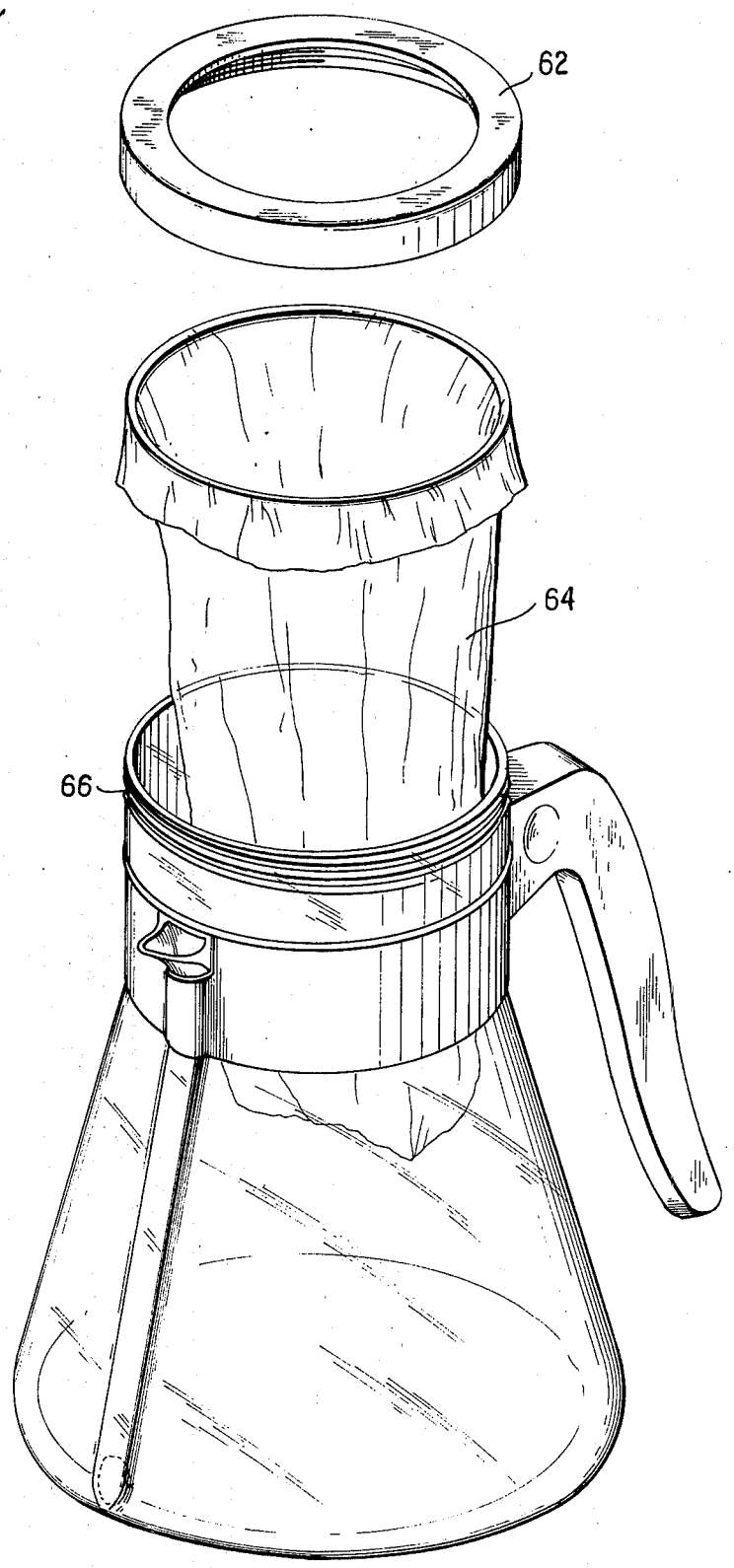
FIG. 7 is an exploded, perspective view of a coffee receptacle constructed in accordance with a prior patented concept wherein the pour spout is external of the receptacle.

In prior coffee receptacles based on the concept herein discussed the pour spout has been formed externally of the receptacle with the follower being positioned internally thereof. The prior art embodiment disclosed in FIGS. 7–9 is exemplary.

The present invention is directed to the achievement of the same ends but wherein both the pour spout and follower are positioned internally of the receptacle so that a conventionally produced receptacle may be used rather than one especially configured to have an external pour spout.

Figure 1:
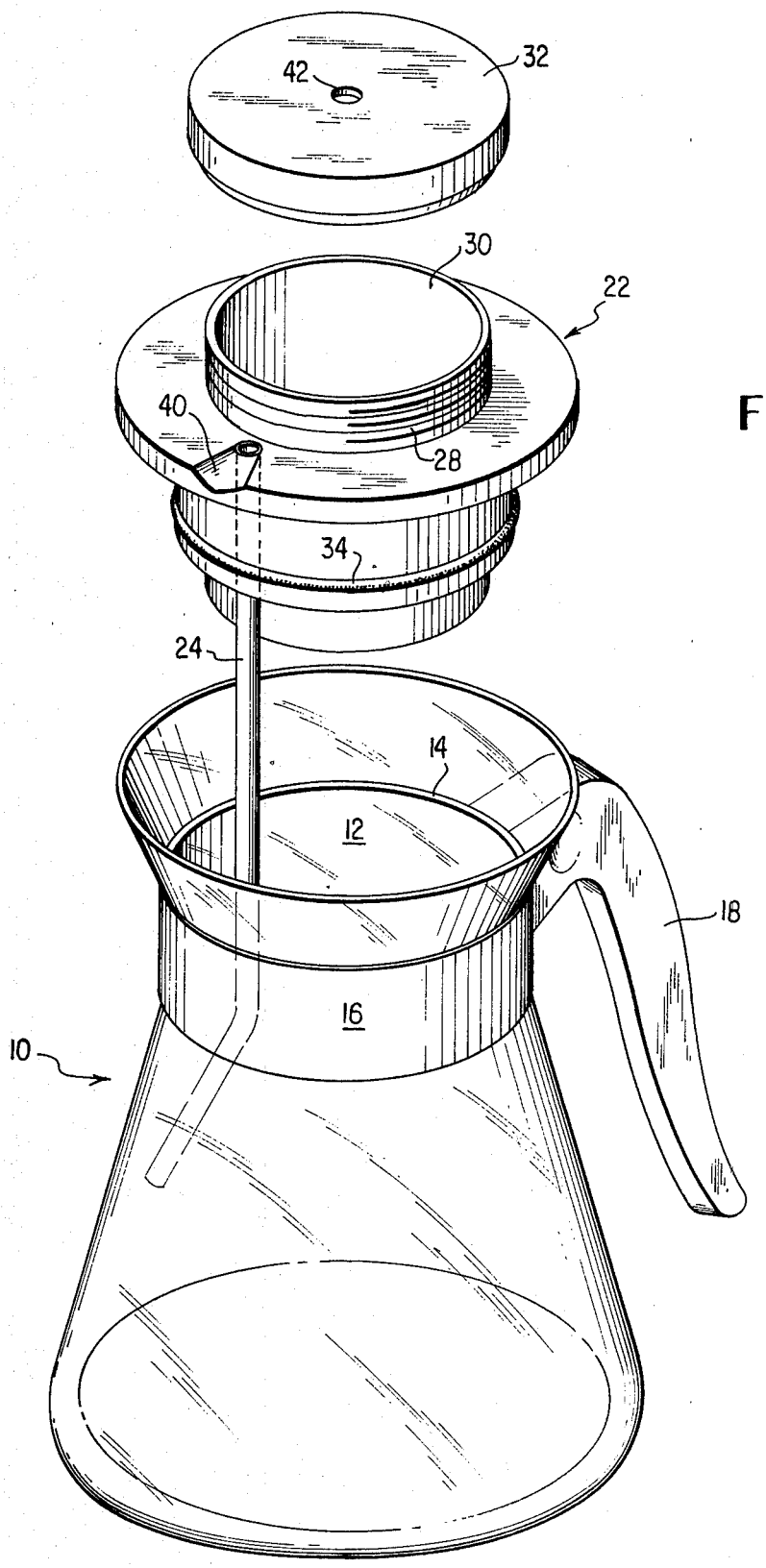
FIG. 1 is an exploded, perspective view of a conventional coffee receptacle and a portion of the top assembly therefor.
Figure 2:
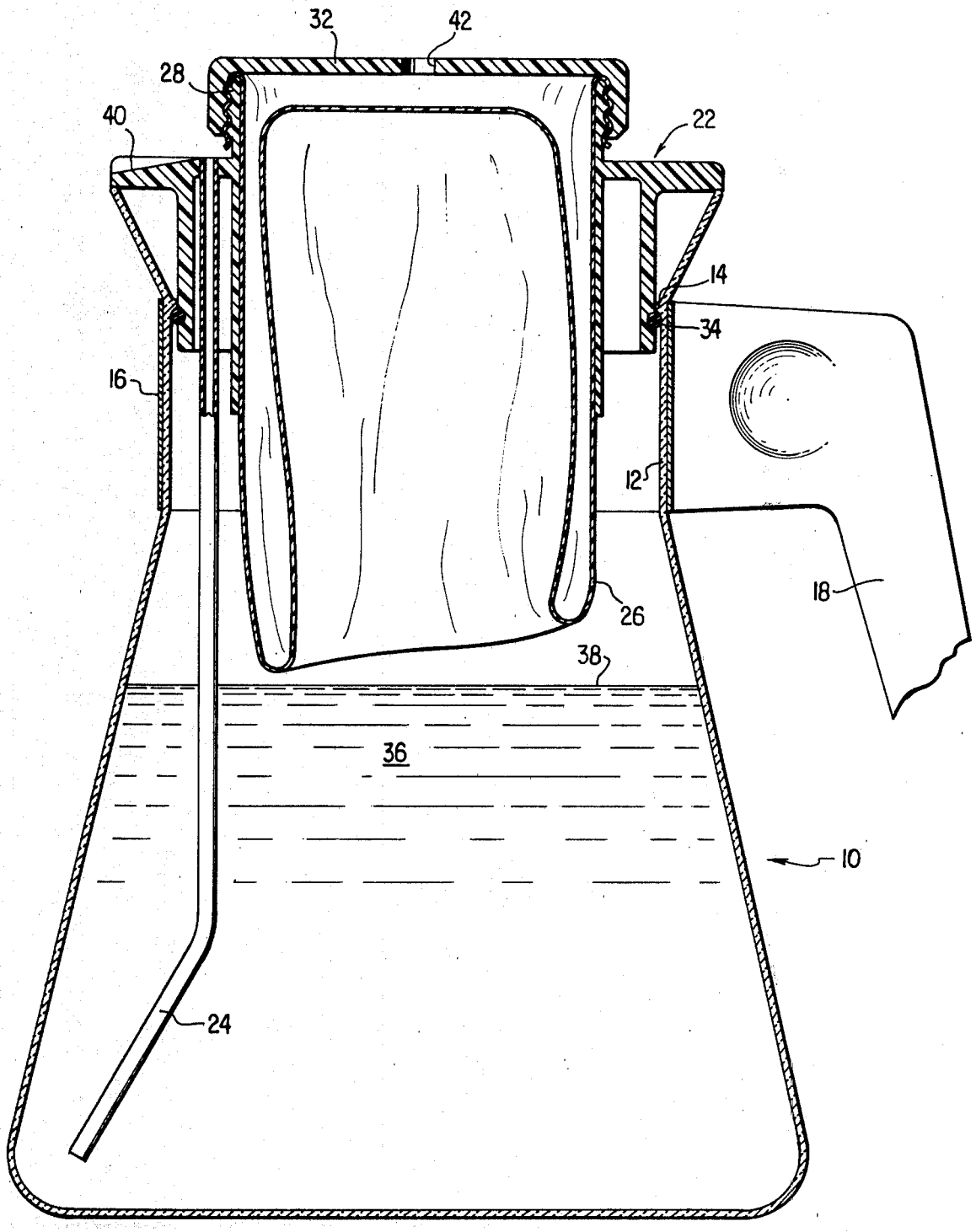
FIG. 2 is a sectional view, with parts in elevation, of the receptacle of FIG. 1 interfitted with the complete top assembly including a flexible bag type follower.

In FIGS. 1 and 2 are illustrated a conventional, twelve cup coffee receptacle 10 whose body portion is constructed of borosilicate glass the constricted neck portion 12 of which is internally formed with a circumferential bead 14 and is externally grasped by a metal band 16 supporting a dispensing handle 18. A top assembly 20, shown in its entirety in FIG. 2 interfitted with receptacle 10, includes a molded plastic plug 22, a depending pour spout 24 and a flexible bag follower 26 secured at screw threads 28 surrounding a central opening 30 in plug 22 by a screw cap 32. The external periphery of plug 22 is sealed with respect to the internal periphery of receptacle neck 12 by flexible O-ring 34, carried by plug 22, which deforms to seat below bead 14 when the top assembly is forced downwardly into the receptacle. The flexible bag 26 is, of course, imperforate and with the open end thereof secured by cap 32 as illustrated in FIG. 2 the body of contained coffee 36 is sealed with respect to atmosphere. The only air contact with the contained coffee is at coffee level 38 within pour spout 24. The liquid column within pour spout 24 blow coffee level 38 acts as a liquid seal between that oxidation which occurs at the upper coffee level in the pour spout and the reservoir or main body of contained coffee 36. Pour spout 24 is formed integrally with plug 22 or is made integral therewith as by sonic welding or the like and extends to the upper surface of plug 22 to terminate adjacent a recess 40 formed in the upper surface of plug 22 which serves as a pour lip. Pour spout 24 is offset to one side of plug 22 to allow room for the centrally located follower to expand and the lower end thereof is angled away from receptacle handle 18 to insure that the lower end of the pour spout will remain submerged until only a small volume of coffee remains in the receptacle, such as about one cup. The screw cap 32 is vented at 42 to expose the inner surface of the follower to atmosphere so that upon dispensing coffee via pour spout 24 the bag will expand from the convoluted position of FIG. 2 to maintain atmospheric pressure on the contained coffee so that it may be dispensed by pouring in conventional fashion.

Since the amount of oxidation that occurs in pour spout 24 is a function of surface area exposure and since there is some mixing of this surface oxidized coffee back into the coffee reservoir as coffee is poured in addition to that mixing which occurs by convection; it will be seen that the time interval over which the coffee will remain fresh varies inversely with the diameter of the pour spout and the number of times coffee is dispensed from the receptacle. Exemplary is the use of a ½" diameter pour spout with frequent dispensing to deplete the receptacle over a four hour period; the last cup sill retains the flavor and aroma of freshly brewed coffee. Using a ¼" diameter pour spout with equal time dispensing over an eight hour period produces the same result. In the case of the larger diameter pour spout (½"), with equal frequency dispensing to deplete the receptacle after six hours; deterioration is noticeable between the fourth and fifth hours. All of the foregoing is based upon constant heating of the coffee with the receptacle trivet supported above a 75 watt warming burner producing a temperature of 175° F. in the filled receptacle. The trivet is needed to dissipate the input heat energy from a conventional warming burner because, since the receptacle herein disclosed is sealed during the time it is heated, less heat input is required to keep it at drinking temperature.

In operation, receptacle 10 is filled with coffee following which time the top assembly 20, with bag 26 secured by cap 32, is thrust into neck 12 until O-ring seal 34 seats behind bead 14. As coffee is subsequently dispensed through pour spout 24, bag 26 expands to keep atmospheric pressure on the contained coffee.

Figure 3:
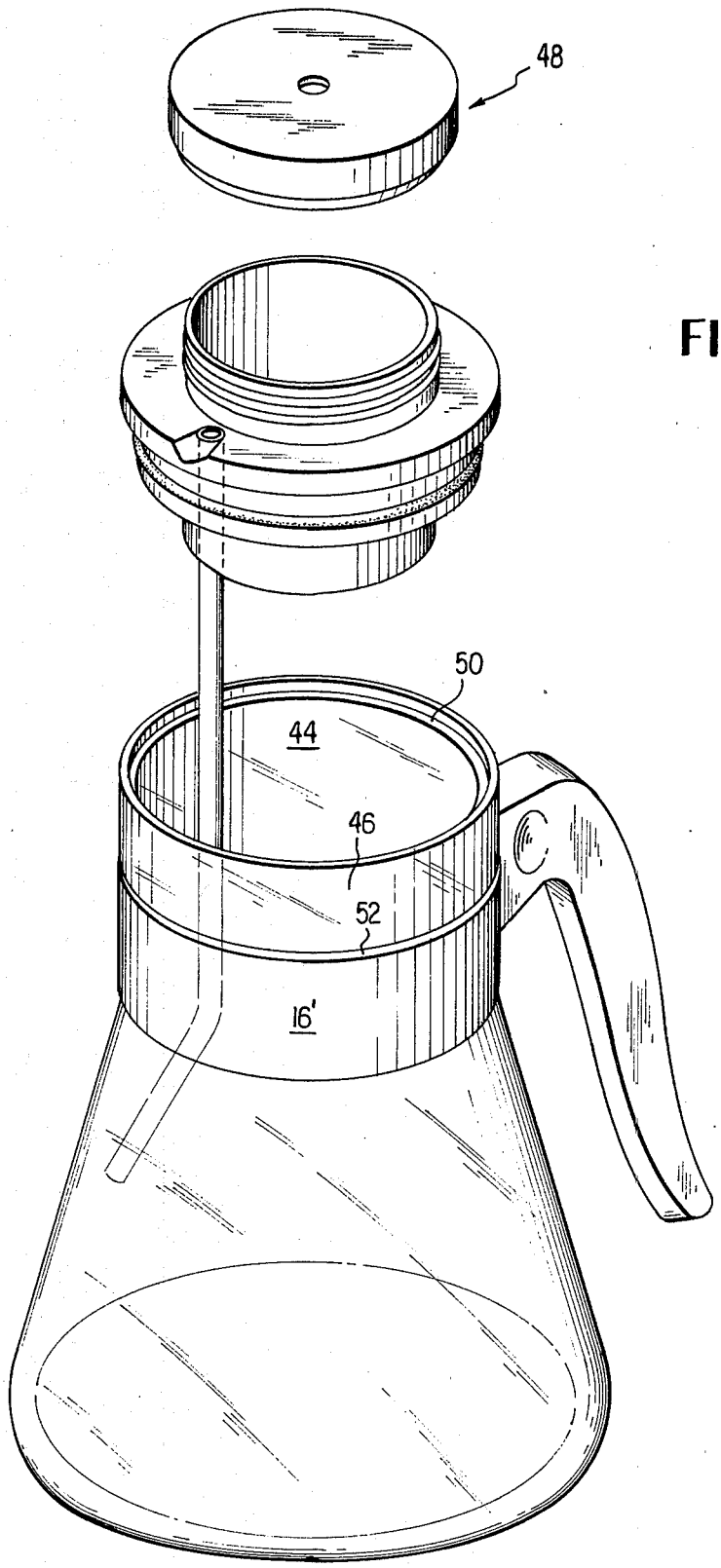
FIG. 3 is a view similar to FIG. 1 of a modified receptacle.
Figure 4:
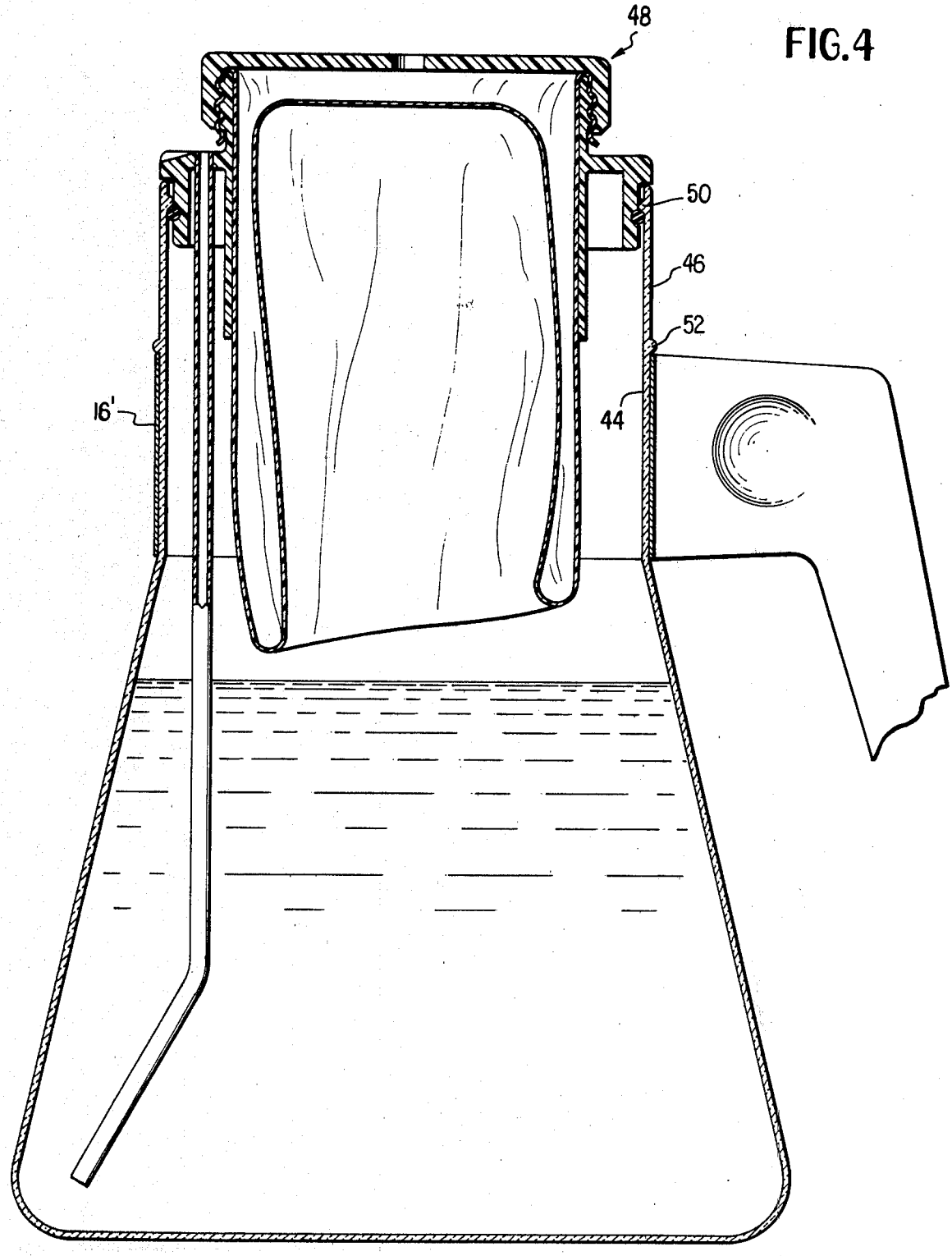
FIG. 4 is a sectional view, with parts in elevation, of the receptacle of FIG. 3 interfitted with the complete top assembly including a flexible bag type follower.

The embodiment of FIGS. 3 and 4 is identical in all respects to that of FIGS. 1 and 2 except that the cylindrical neck portion 44 is continued upwardly in a cylindrical extension 46 rather than being outwardly flared as in FIG. 1 and the top assembly 48 is correspondingly modified to seat below internal bead 50 while an external bead 52 is formed at the neck to overlie metal band 16'.

Figure 5:
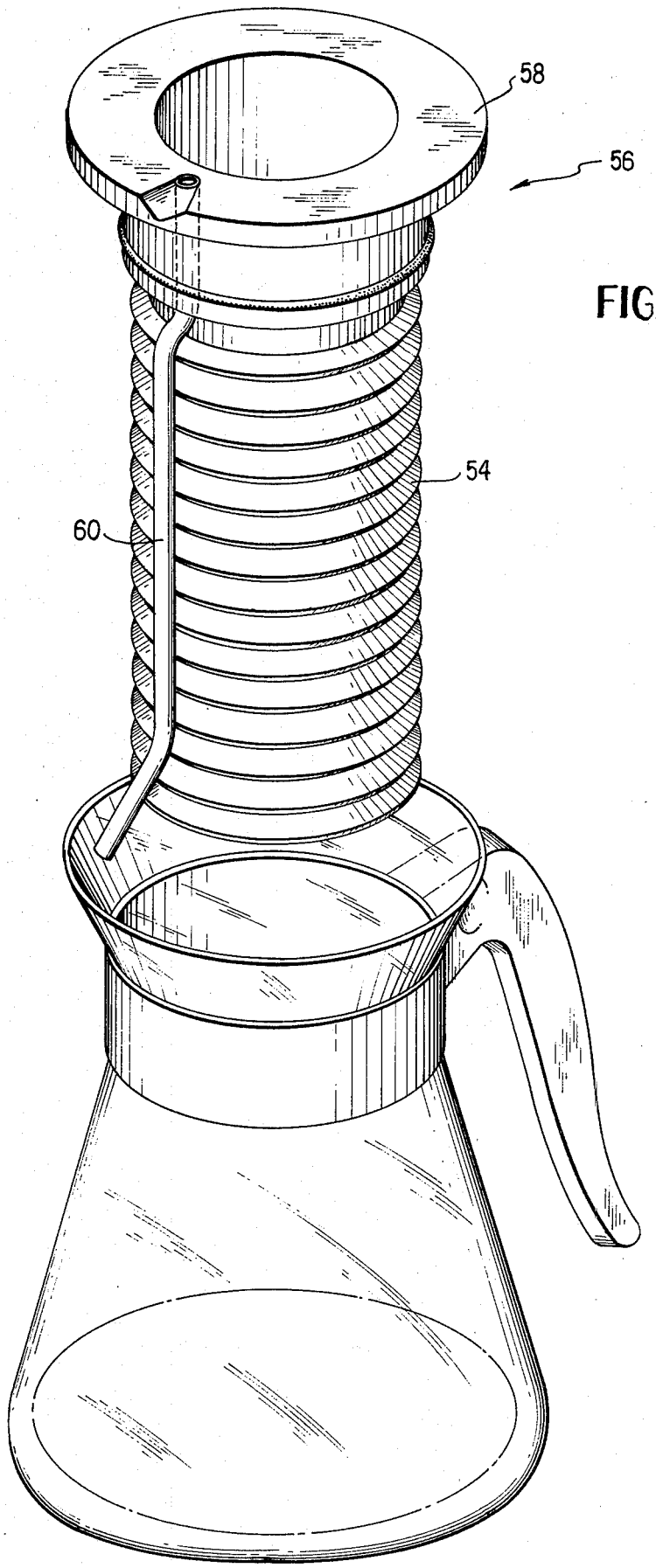
FIG. 5 is an exploded, perspective view of a conventional coffee receptacle like that shown in FIG. 1 and the complete top assembly therefor.
Figure 6:
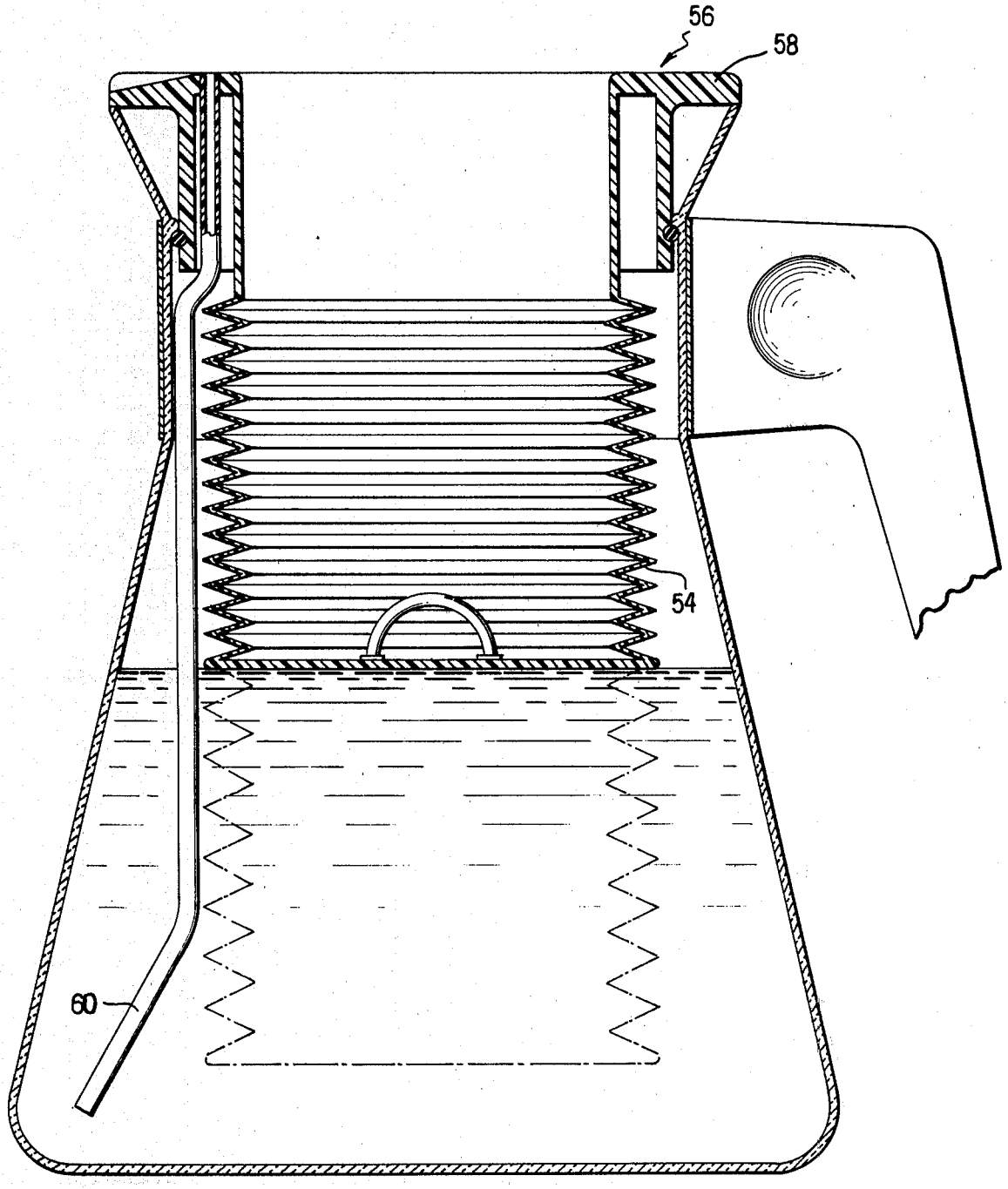
FIG. 6 is a sectional view, with parts in elevation, of the receptacle of FIG. 5 interfitted with its top assembly which includes a bellows type follower.

The embodiment of FIGS. 5 and 6 differs from that of FIG. 1 primarily in the substitution of a bellows type follower 54 for the bag type follower of the previous embodiments. Thus the top assembly 56 includes the plug 58, bellows 54 and pour spout 60. Bellows 54 is formed integrally with plug 58 or made integral therewith as by sonic welding or the like and, consequently, there is no necessity for an additional securing element corresponding to the cap 32 of FIG. 1. The operation of the embodiment of FIGS. 5 and 6 is identical with that of FIGS. 1 and 2 except that it is the bellows which expands and acts as a follower.

In all of the embodiments, when the coffee level diminishes to the lower end of the pour spout, approximately one cup of coffee will remain in the pot. As soon as the lower end of the pour spout is uncovered, the seal is broken and the top assembly can be readily removed to dispense the last cup directly from the receptacle in conventional fashion.

In any of the above embodiments, a screw threaded engagement between the top assembly and receptacle may be effected as in the prior art illustration appearing in FIGS. 7–9 wherein the screw top 62 seals bag 64 to the receptacle via screw threads 66.

I Claim:

1. For use in association with a coffee decanter of the type primarily intended for use with automatic coffee makers, and which comprises an imperforate container having a substantially symmetrical profile and an open mouth, a top assembly including a body portion having an external periphery for mating with and in substantially sealing engagement with the open mouth of the coffee decanter, an elongated pour spout having an upper end in which the outer periphery thereof is sealed with respect to said body portion and for which the inner diameter of the upper end thereof opens through said body portion to the side thereof exterior of the coffee decanter; and a lower end extendant within the coffee decanter to and opening adjacent the bottom thereof, a substantially central bore opening therethrough, and an imperforate flexible follower as an adjunct of and opening through said central bore and sealing said central bore with respect to the interior of the coffee decanter, said flexible follower being dependent from said top assembly to within said coffee decanter and of a dimension for engagement with the upper surface of coffee within the coffee decanter and for following the descending level of coffee within the decanter as the same is poured therefrom through said pour spout.

2. A top assembly as specified in claim 1 wherein said flexible follower comprises an integral part of said top assembly.

3. A top assembly as specified in claim 2 wherein said flexible follower comprises a bellows.

4. A top assembly as specified in claim 1 wherein the upper end of said flexible follower is removably attached to said body portion of said top assembly about said central bore thereof.

5. A top assembly as specified in either of claims 1, 2, 3, or 4, and wherein said top assembly includes a cap providing a contiguous cover for said central bore opening thereof and having a vent for egress of air therethrough and into said flexible follower.

6. A top assembly as specified in claim 4 and wherein said top assembly includes a cap engageable with said central bore peripheral configuration for attachment of said flexible follower to said body portion of said top assembly, said cap including a vent for egress of air therethrough and into said flexible follower.

* * * * *